US009673525B2

(12) United States Patent
Zheng et al.

(10) Patent No.: US 9,673,525 B2
(45) Date of Patent: Jun. 6, 2017

(54) APPARATUS AND METHODS FOR WIRELESS COMMUNICATION

(75) Inventors: Ming Zheng, Hampshire (GB); Hanyang Wang, Oxfordshire (GB)

(73) Assignee: Nokia Technologies Oy, Espoo (FI)

( * ) Notice: Subject to any disclaimer, the term of this patent is extended or adjusted under 35 U.S.C. 154(b) by 358 days.

(21) Appl. No.: 14/119,505

(22) PCT Filed: May 23, 2011

(86) PCT No.: PCT/IB2011/052243

§ 371 (c)(1),
(2), (4) Date: Dec. 26, 2013

(87) PCT Pub. No.: WO2012/160413

PCT Pub. Date: Nov. 29, 2012

(65) Prior Publication Data

US 2014/0097991 A1 Apr. 10, 2014

(51) Int. Cl.
*H01Q 9/16* (2006.01)
*H01Q 9/04* (2006.01)
(Continued)

(52) U.S. Cl.
CPC ..... *H01Q 9/04* (2013.01); *H01Q 1/243* (2013.01); *H01Q 5/371* (2015.01); *H01Q 7/00* (2013.01); *H01Q 9/265* (2013.01); *H01Q 9/42* (2013.01)

(58) Field of Classification Search
CPC ..... H01Q 9/04; H01Q 9/265; H01Q 5/371; H01Q 7/00; H01Q 9/42; H01Q 1/243
See application file for complete search history.

(56) References Cited

U.S. PATENT DOCUMENTS 5,198,826 A 3/1993 Ito
6,693,600 B1 2/2004 Elliot
(Continued)

FOREIGN PATENT DOCUMENTS

CN 100544117 C 9/2009
CN 100584066 C 1/2010
(Continued)

OTHER PUBLICATIONS

International Search Report an Written Opinion received in corresponding Patent Cooperation Treaty Application No. PCT/IB2011/052243. Dated Feb. 7, 2012. 9 pages.
(Continued)

*Primary Examiner* — Graham Smith
*Assistant Examiner* — Noel Maldonado
(74) *Attorney, Agent, or Firm* — Alston & Bird LLP

(57) ABSTRACT

An apparatus comprising: a first antenna having a first end coupled to a first port and a second end coupled to a second port, the first antenna extending between the first and second ends and having a mid-point substantially halfway between the first and second ends, the first antenna having a first electrical length and resonant in a first operational resonant frequency band; a second antenna extending from the first antenna at a position between one of the first and second ends and the mid-point of the first antenna, the second antenna having a second electrical length and resonant in a second operational resonant frequency band; and a third antenna extending from the first antenna at position between one of the first and second ends and the mid-point of the first antenna, the third antenna having a third electrical length and resonant in a third operational resonant frequency band.

20 Claims, 11 Drawing Sheets

(51) Int. Cl.

| | |
|---|---|
| ***H01Q 1/24*** | (2006.01) |
| ***H01Q 7/00*** | (2006.01) |
| ***H01Q 9/42*** | (2006.01) |
| ***H01Q 5/371*** | (2015.01) |
| ***H01Q 9/26*** | (2006.01) |

(56) References Cited

U.S. PATENT DOCUMENTS

| | | | | |
|---|---|---|---|---|
| 7,692,595 | B2 * | 4/2010 | Kim | H01Q 1/243 343/702 |
| 2006/0293078 | A1 | 12/2006 | Qi et al. | |
| 2007/0069954 | A1 | 3/2007 | Kenoun et al. | |
| 2008/0129605 | A1 | 6/2008 | Sakurai et al. | |
| 2010/0103064 | A1 | 4/2010 | Yang et al. | |
| 2010/0117907 | A1 | 5/2010 | Su et al. | |
| 2010/0245201 | A1 | 9/2010 | Hossain et al. | |
| 2010/0271264 | A1 | 10/2010 | Li et al. | |

FOREIGN PATENT DOCUMENTS

| | | | |
|---|---|---|---|
| EP | 0954054 | A1 | 11/1999 |
| EP | 1641077 | A1 | 3/2006 |
| EP | 2418733 | A2 | 2/2012 |
| EP | 2466685 | A1 | 6/2012 |
| RU | 2192079 | C2 | 10/2002 |
| WO | 03/007422 | A1 | 1/2003 |
| WO | 2006/011008 | A1 | 2/2006 |
| WO | 2011/000416 | A1 | 1/2011 |
| WO | 2011/019001 | A1 | 2/2011 |

OTHER PUBLICATIONS

"The loop wire was a VHF antenna and the two monopoles were the UHF antenna with the long monopole being a ground plane", Google, Retrieved on Mar. 12, 2015, Webpage available at : http://www.google.com/search?sourceid=navclient&hl=en-GB&ie=UTF-8&rlz=1T4GFRG_en-GBIN321US409&q=%22The+loop+wire+was+a+VHF+antenna+and+the+two+monopoles+were+the+UHF+antenna+with+the+long+monopole+being+a+ground+plane%22.

Wong et al., "Small Size Printed Loop Antenna for Penta Band Thin-Profile Mobile Phone Application", Microwave and Optical Technology Letters, vol. 51, No. 6, Jun. 2009, pp. 1512-1517.

Office action received for corresponding Chinese Patent Application No. 201180072204.0, dated Jan. 6, 2015, 6 pages of office action and 5 pages of office action translation Available.

Extended European Search Report received for corresponding European Patent Application No. 11866341.8, dated Feb. 13, 2015, 11 pages.

Third Office Action for corresponding Chinese Patent Application No. 201180072204.0, dated May 13, 2016, with English-language summary, 5 pages.

Office action received for corresponding Chinese Patent Application No. 201180072204.0, dated Oct. 26, 2015, 3 pages of office action and 3 pages of office action translation Available.

Fourth Office Action for corresponding Chinese Patent Application No. 201180072204.0, dated Nov. 7, 2016, with English-language summary, 10 pages.

* cited by examiner

APPARATUS AND METHODS FOR WIRELESS COMMUNICATION

RELATED APPLICATION

This application was originally filed as PCT Application No. PCT/IB2011/052243 filed May 23, 2011.

TECHNOLOGICAL FIELD

Embodiments of the present invention relate to apparatus and methods for wireless communication. In particular, they relate to apparatus for wireless communication in an electronic communication device.

BACKGROUND

Apparatus, such as portable communication devices, usually include radio circuitry and one or more antennas for enabling the apparatus to communicate wirelessly with other apparatus. In recent years, users have demanded that such apparatus be operable in a plurality of different operational frequency bands. However, user demand has also led to such apparatus being reduced in size and this reduction in size usually leads to a decrease in performance and/or efficiency and/or bandwidth of the one or more antennas.

It would therefore be desirable to provide alternative apparatus.

BRIEF SUMMARY

According to various, but not necessarily all, embodiments of the invention there is provided an apparatus comprising: a first antenna having a first end configured to couple to a first port and a second end configured to couple to a second port, the first antenna extending between the first end and the second end and having a mid-point substantially halfway between the first end and the second end, the first antenna being configured to have a first electrical length and resonate in a first operational resonant frequency band; a second antenna extending from the first antenna at a position between one of the first end and the second end and the mid-point of the first antenna, the second antenna being configured to have a second electrical length and resonate in a second operational resonant frequency band; and a third antenna extending from the first antenna at a position between one of the first end and the second end and the mid-point of the first antenna, the third antenna being configured to have a third electrical length and resonate in a third operational resonant frequency band.

The apparatus may be for wireless communication.

The second antenna may be a monopole antenna and may be configured to resonate in a $3\lambda/4$ mode to operate in the second operational resonant frequency band.

The second electrical length may extend from one of the first end and the second end of the first antenna to an open end of the second antenna.

The third antenna may be a monopole antenna and may be configured to resonate in a $3\lambda/4$ mode to operate in the third operational resonant frequency band.

The third electrical length may extend from one of the first end and the second end of the first antenna to an open end of the third antenna.

The first antenna may define a cavity and the second and third antennas may be positioned within the cavity.

The first antenna may define a cavity and at least one of the second and third antennas may be positioned external to the cavity.

The midpoint may be positioned to overlie a first conductive portion of the first antenna and a second conductive portion of the first antenna, the first and second conductive portions may be configured to couple to the first and second ports respectively.

The first antenna may be configured to operate in a fourth operational resonant frequency band and in a fifth operational resonant frequency band, the second, third, fourth and fifth operational resonant frequency bands may be configured to provide a reflection coefficient of at least −6 dB between 1.6 GHz and 2.7 GHz.

The second port may be a ground point. The first port may be a feed point.

The second electrical length may be different to the third electrical length and the second operational resonant frequency band may be different to the third operational resonant frequency band.

The second electrical length may be substantially the same as the third electrical length and the second operational resonant frequency band may substantially overlap the third operational resonant frequency band.

The second antenna may be configured to have a first physical length and the third antenna may be configured to have a second physical length, the first physical length may be different to the second physical length.

According to various, but not necessarily all, embodiments of the invention there is provided a module comprising an apparatus as described in any of the preceding paragraphs.

According to various, but not necessarily all, embodiments of the invention there is provided an electronic communication device comprising an apparatus as described in any of the preceding paragraphs.

According to various, but not necessarily all, embodiments of the invention there is provided a method comprising: providing a first antenna having a first end configured to couple to a first port and a second end configured to couple to a second port, the first antenna extending between the first end and the second end and having a mid-point substantially halfway between the first end and the second end, the first antenna being configured to have a first electrical length and resonate in a first operational resonant frequency band; providing a second antenna extending from the first antenna at a position between one of the first end and the second end and the mid-point of the first antenna, the second antenna being configured to have a second electrical length and resonate in a second operational resonant frequency band; and providing a third antenna extending from the first antenna at a position between one of the first end and the second end and the mid-point of the first antenna, the third antenna being configured to have a third electrical length and resonate in a third operational resonant frequency band.

The second antenna may be a monopole antenna and may be configured to resonate in a $3\lambda/4$ mode to operate in the second operational resonant frequency band.

The second electrical length may extend from one of the first end and the second end of the first antenna to an open end of the second antenna.

The third antenna may be a monopole antenna and may be configured to resonate in a $3\lambda/4$ mode to operate in the third operational resonant frequency band.

The third electrical length may extend from one of the first end and the second end of the first antenna to an open end of the third antenna.

The first antenna may define a cavity and the second and third antennas may be positioned within the cavity.

The first antenna may define a cavity and at least one of the second and third antennas may be positioned external to the cavity.

The midpoint may be positioned to overlie a first conductive portion of the first antenna and a second conductive portion of the first antenna, the first and second conductive portions may be configured to couple to the first and second ports respectively.

The first antenna may be configured to operate in a fourth operational resonant frequency band and in a fifth operational resonant frequency band, the second, third, fourth and fifth operational resonant frequency bands may be configured to provide a reflection coefficient of at least −6 dB between 1.6 GHz and 2.7 GHz.

The second port may be a ground point. The first port may be a feed point.

The second electrical length may be different to the third electrical length and the second operational resonant frequency band may be different to the third operational resonant frequency band.

The second electrical length may be substantially the same as the third electrical length and the second operational resonant frequency band may substantially overlap the third operational resonant frequency band.

The second antenna may be configured to have a first physical length and the third antenna may be configured to have a second physical length, the first physical length may be different to the second physical length.

BRIEF DESCRIPTION

For a better understanding of various examples of embodiments of the present invention reference will now be made by way of example only to the accompanying drawings in which.

DETAILED DESCRIPTION

Figure 1:
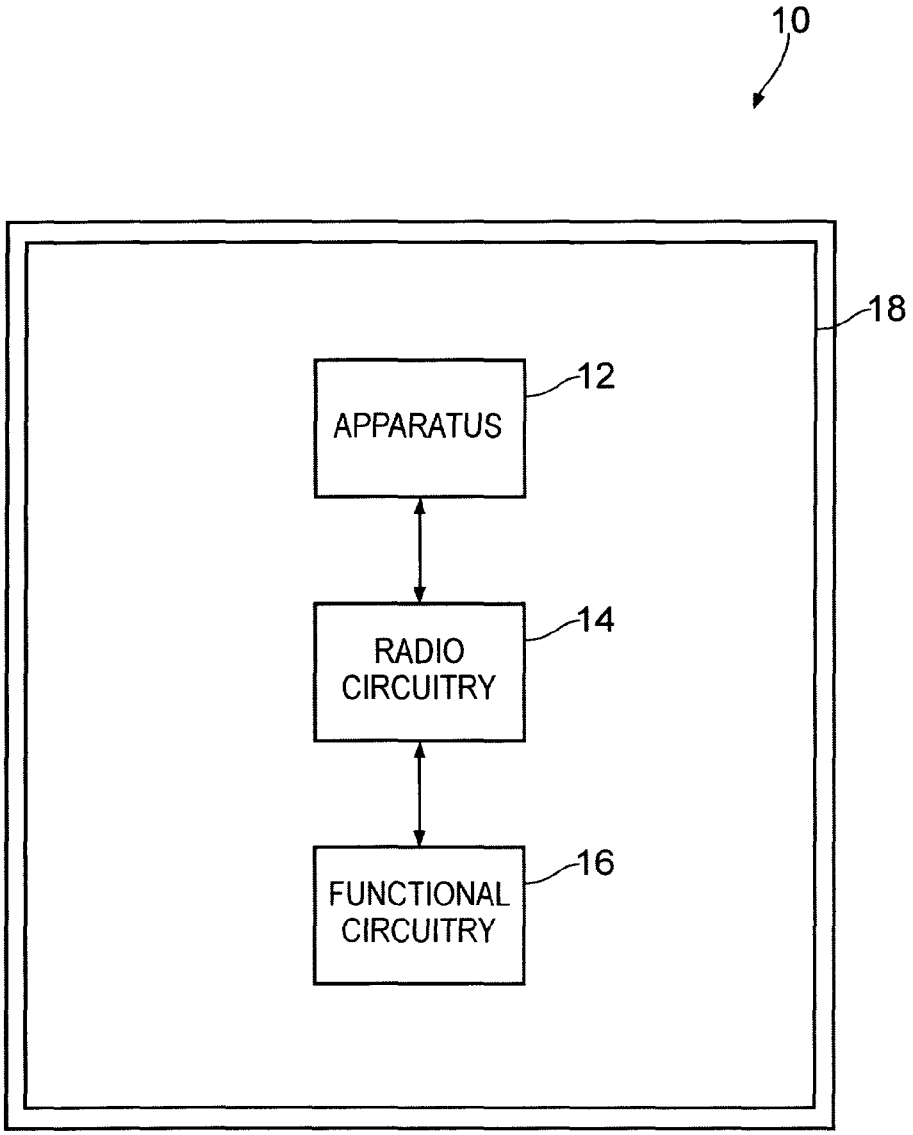
FIG. 1 illustrates a schematic diagram of an electronic communication device according to various embodiments of the invention.

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

FIGS. 2, 3A, 3B, 5, 6, 7, 8, 9 illustrate an apparatus 12 comprising: a first antenna 20 having a first end 32 configured to couple to a first port and a second end 34 configured to couple to a second port, the first antenna 20 extending between the first end 32 and the second end 34 and having a mid-point 36 substantially halfway between the first end 32 and the second end 34, the first antenna 20 being configured to have a first electrical length 38 and resonate in a first operational resonant frequency band; a second antenna 22 extending from the first antenna 20 at a position between one of the first end 32 and the second end 34 and the mid-point 36 of the first antenna 20, the second antenna 22 being configured to have a second electrical length 42 and resonate in a second operational resonant frequency band; and a third antenna 24 extending from the first antenna 20 at position between one of the first end 32 and the second end 34 and the mid-point 36 of the first antenna 20, the third antenna 24 being configured to have a third electrical length 46 and resonate in a third operational resonant frequency band.

In more detail, FIG. 1 illustrates an electronic communication device 10 which may be any apparatus such as a portable electronic communication device (for example, a mobile cellular telephone, a tablet computer, a laptop computer, a personal digital assistant or a hand held computer), a non-portable electronic device (for example, a personal computer or a base station for a cellular network), a portable multimedia device (for example, a music player, a video player, a game console and so on) or a module for such devices. As used here, 'module' refers to a unit or apparatus that excludes certain parts or components that would be added by an end manufacturer or a user.

The electronic communication device 10 comprises an apparatus 12, radio circuitry 14, functional circuitry 16 and a ground member 18. The apparatus 12 is configured to transmit and receive, transmit only or receive only electromagnetic signals. The radio circuitry 14 is connected between the apparatus 12 and the functional circuitry 16 and may include a receiver and/or a transmitter. The functional circuitry 16 is operable to provide signals to, and/or receive signals from the radio circuitry 14. The electronic communication device 10 may optionally include one or more matching circuits between the apparatus 12 and the radio circuitry 14.

In the embodiment where the electronic communication device 10 is a portable electronic communication device (such as a mobile phone), the functional circuitry 16 may include a processor, a memory and input/output devices such as an audio input device (a microphone for example), an audio output device (a loudspeaker for example) and a display.

The apparatus 12 and the electronic components that provide the radio circuitry 14 and the functional circuitry 16 may be interconnected via the ground member 18 (for example, a printed wiring board). The ground member 18 may be used as a ground plane for the apparatus 12 by using one or more layers of the printed wiring board 18. In other embodiments, some other conductive part of the electronic communication device 10 (a battery cover for example) may be used as the ground member 18 for the apparatus 12. The ground member 18 may be formed from several conductive parts of the electronic communication device 10, for example and not limited to the printed wiring board, a conductive battery cover, and/or at least a portion of an external conductive casing or housing of the electronic communication device 10. The ground member 18 may be planar or non-planar.

The apparatus 12 and the radio circuitry 14 are configured to operate in a plurality of operational resonant frequency bands and via one or more protocols. For example, the operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hyper local area network (HLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

A frequency band over which an apparatus can efficiently operate using a protocol is a frequency range where the apparatus' reflection coefficient is less than an operational threshold. For example, efficient operation may occur when the apparatus' reflection coefficient is better than (that is, less than) −6 dB or −10 dB.

Figure 2:
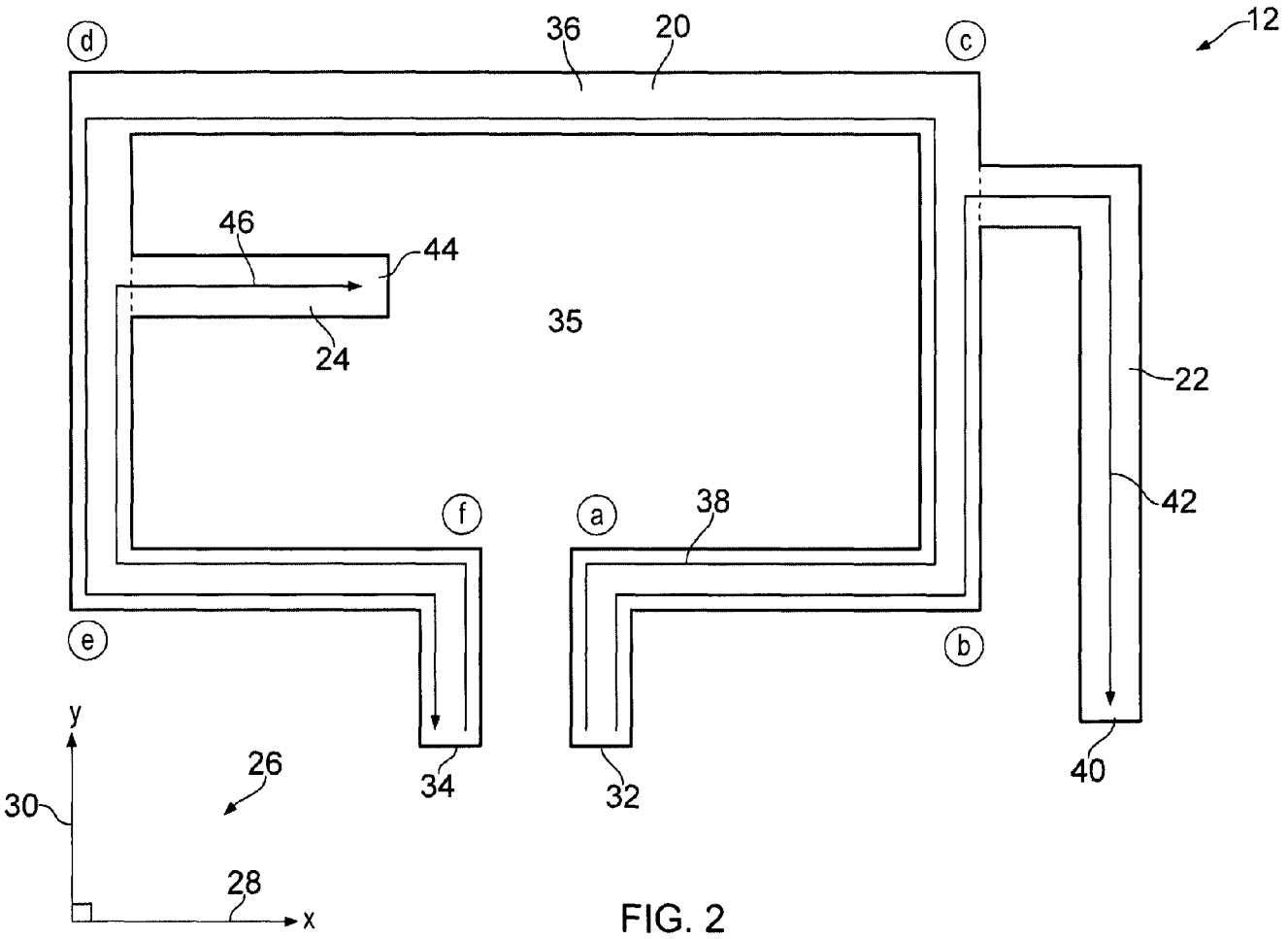
FIG. 2 illustrates a plan view of an apparatus according to various embodiments of the invention.

FIG. 2 illustrates a plan view of an apparatus 12 according to various embodiments of the invention. The apparatus 12 includes a first antenna 20, a second antenna 22 and a third antenna 24. FIG. 2 also illustrates a Cartesian co-ordinate axis 26 that includes an X axis 28 and a Y axis 30 that are orthogonal to one another.

The first antenna 20 has a loop like structure and will consequently be referred to as a first loop antenna in the detailed description. The first antenna 20 may be considered to form a loop antenna or a folded dipole antenna.

The first loop antenna 20 is substantially planar and has a first end 32, a second end 34 and extends between the first end 32 and the second end 34 in a loop structure. The first loop antenna 20 defines a cavity 35 therein and has a mid-point 36 which is substantially halfway between the first end 32 and the second end 34.

In more detail, the first loop antenna 20 is formed from a conductive track which extends from the first end 32 in the +Y direction until position (a) and then makes a right angled turn and extends in the +X direction until position (b). The first loop antenna 20 then makes a right angled turn at position (b) and extends in the +Y direction until position (c). The first loop antenna 20 then makes a right angled turn at position (c) and extends in the −X direction until position (d). The first loop antenna 20 then makes a right angled turn at position (d) and extends in the −Y direction until position (e). The first loop antenna 20 then makes a right angled turn at position (e), extends in the +X direction until position (f) and then makes a right angled turn and extends in the −Y direction until the second end 34. It should be appreciated however that the first loop antenna 20 may have any suitable loop structure, may be non-planar in other embodiments and at least a portion of the loop structure may be disposed overlying at least a portion of the ground member. In other embodiments at least a portion of the loop structure may not be disposed overlying at least a portion of the ground member.

The first end 32 is configured to couple to a first port such as a feed point and the second end 34 is configured to couple to a second port such as a ground point so that a single-ended feed is deployed. In some embodiments, the first end 32 and the second end 34 may be specially configured to connect to the first and second ports and may include connectors such as connector pins or leaf springs. In other embodiments, the first end 32 and the second end 34 may not be specially configured to connect to the first and second ports and are consequently, suitable for connection to the first port and the second port (via solder for example).

The first loop antenna 20 has a first electrical length 38 that extends between the first end 32 and the second end 34. It should be appreciated that the first electrical length may also include one or more reactive components (such as inductors and capacitors) that are connected between the first loop antenna 20 and the radio circuitry 14. The first electrical length 38 is configured so that the first loop antenna 20 may resonate in one or more resonant modes and in at least a first operational resonant frequency band.

The second antenna 22 may be any suitable antenna and may be a monopole antenna, a loop antenna, a meandering antenna or a T type antenna. In this embodiment, the second antenna 22 is a monopole antenna and extends from the first loop antenna 20 from a position between positions (b) and (c). In more detail, the second antenna 22 extends from the first loop antenna 20 in the +X direction and then makes a right angled turn and extends in the −Y direction until an open end 40 of the second antenna 22. Consequently, the second antenna 22 extends out from the first loop antenna 20 and is not positioned within the cavity 35.

In other embodiments, the second antenna 22 may extend from the first loop antenna 20 at any position between one of the first end 32 and the second end 34 and the mid-point 36 of the first loop antenna 20. In some embodiments, the second antenna 22 may extend from the first loop antenna 20 at any position between 2/6L and 3/6L and between 3/6L and 4/6L (where L is the physical length of the first loop antenna 20, the first end 32 being at 0/6L, the second end 34 being at 6/6L and the mid-point 36 being at 3/6L). Additionally, the second antenna 22 may extend into, and be positioned within, the cavity 35 in other embodiments.

The second antenna 22 may be integral with the first loop antenna 20. In particular, the second antenna 22 and the first loop antenna 20 may be formed from the same piece of material by cutting or punching out the shape of the second antenna 22 and the first loop antenna 20. In other embodiments, the second antenna 22 may be separate to the first loop antenna 20 and are two or more pieces of material that are formed separately and then joined together (for example, via solder).

The second antenna 22 has a second electrical length 42 that extends between the first end 32 of the first loop antenna 20 and the open end 40 of the second antenna 22. It should be appreciated that the second electrical length 42 may also include one or more reactive components (such as inductors and capacitors) that are connected between the first loop antenna 20 and the radio circuitry 14. The second electrical length 42 is configured so that the second antenna 22 may resonate in one or more resonant modes and in at least a second operational resonant frequency band.

The third antenna 24 may be any suitable antenna and may be a monopole antenna, a loop antenna, a meandering antenna or a T type antenna. In this embodiment, the third antenna 24 is a monopole antenna and extends from the first loop antenna 20 from a position between positions (d) and (e). In more detail, the third antenna 24 extends from the first loop antenna 20 in the +X direction until an open end 44 of the third antenna 24. Consequently, the third antenna 24 extends into the loop structure of the first loop antenna 20 and is therefore positioned within the cavity 35.

In other embodiments, the third antenna 24 may extend from the first loop antenna 20 at any position between one of the first end 32 and the second end 34 and the mid-point 36 of the first loop antenna 20. In some embodiments, the third antenna 24 may extend from the first loop antenna 20 at any position between 2/6L and 3/6L and between 3/6L and 4/6L. Additionally, the third antenna 24 may extend out of the loop structure of the first loop antenna 20 and may therefore not be positioned within the cavity 35.

The third antenna 24 may be integral with the first loop antenna 20. In particular, the third antenna 24 and the first loop antenna 20 may be formed from the same piece of material by cutting or punching out the shape of the third antenna 24 and the first loop antenna 20. In other embodiments, the third antenna 24 may be separate to the first loop antenna 20 and are two or more pieces of material that are formed separately and then joined together (for example, via solder).

The third antenna 24 has a third electrical length 46 that extends between the second end 34 of the first loop antenna 20 and the open end 44 of the third antenna 24. In some embodiments, the third electrical length 46 is different to the second electrical length 42 and may also include one or more reactive components (such as inductors and capacitors) that are connected between the first loop antenna 20 and the radio circuitry 14. The third electrical length 46 is configured so that the third antenna 24 may resonate in one or more resonant modes and in at least a third operational resonant frequency band. In other embodiments, the third electrical length 46 may be substantially the same as the second electrical length 42 and this results in the second antenna 22 and the third antenna 24 having the same operational resonant frequency band.

The second antenna 22 is configured to have a first physical length and the third antenna 24 is configured to have a second physical length. In some embodiments, the first physical length of the second antenna 22 is different to the second physical length of the third antenna 24 and in other embodiments, the first physical length of the second antenna 22 is the same as the second physical length of the third antenna 24.

The apparatus 12 provides an advantage in that since the second antenna 22 and the third antenna 24 are positioned between (but not at) one of the first end 32 and the second end 34 and the mid-point 36 of the first loop antenna 20, the electrical lengths 42, 46 of the second antenna 22 and the third antenna 24 are also within the first loop antenna 20. Consequently, the second antenna 22 and the third antenna 24 may have physical lengths that are relatively small in comparison to their electrical lengths 42, 46 and this may result in the apparatus 12 being relatively small while being able to operate in at least three different operational resonant frequency bands.

Figure 3A:
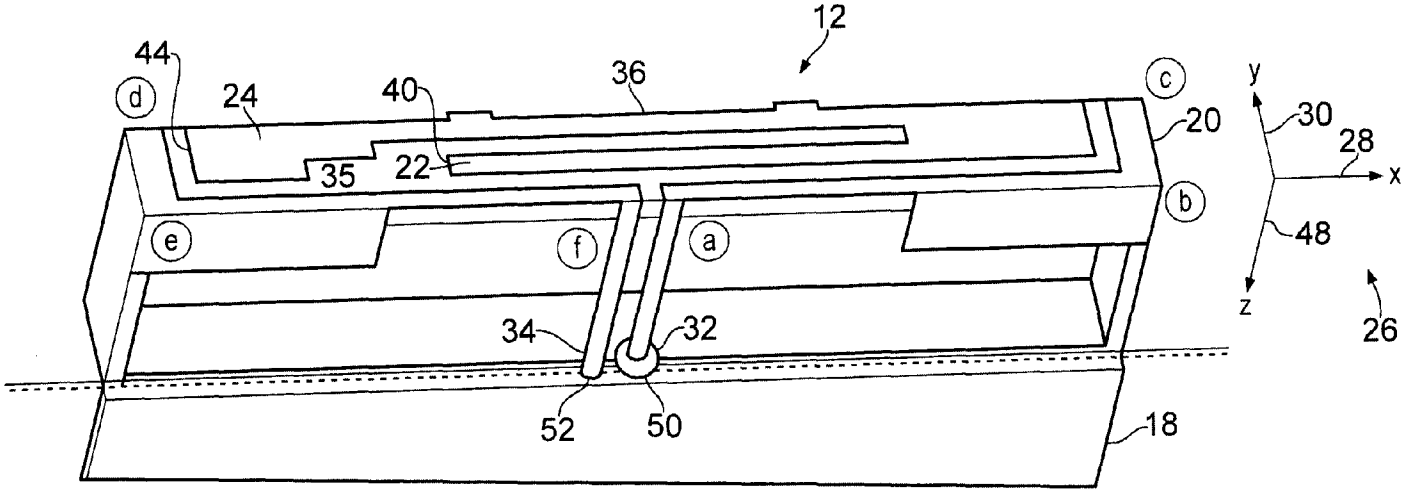
FIGS. 3A and 3B illustrate perspective views of another apparatus according to various embodiments of the invention.
Figure 3B:
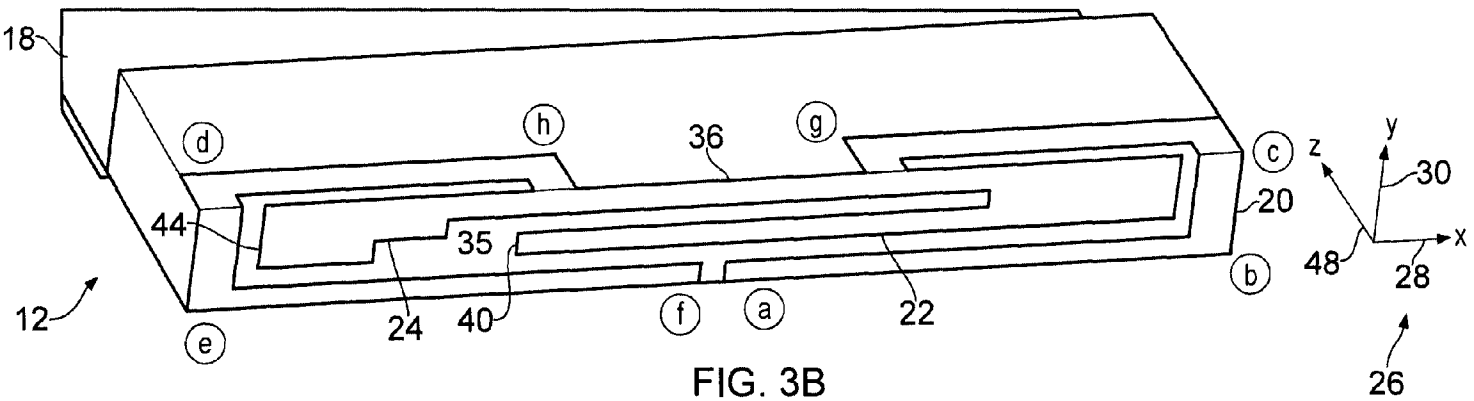

FIGS. 3A and 3B illustrate perspective views of another apparatus 12 according to various embodiments of the invention. The apparatus 12 illustrated in FIGS. 3A and 3B is similar to the apparatus illustrated in FIG. 2 and where the features are similar, the same reference numerals are used. FIGS. 3A and 3B also illustrates the Cartesian co-ordinate axis 26 which additionally includes a Z axis 48 which is orthogonal to the X axis 28 and to the Y axis 30.

The apparatus 12 illustrated in FIGS. 3A and 3B differs from the apparatus illustrated in FIG. 2 in that the first loop antenna 20 is non-planar. In more detail, the first loop antenna 20 extends from the first port 32 in the −Z direction until position (a) and then extends in the +X direction until position (b). At position (c), the first loop antenna 20 extends in the +Z direction and then extends in the −X direction until a position (g). At position (g), the first loop antenna 20 extends −Z direction and then extends in the −X direction until position (h). At position (h), the first loop antenna 20 extends in the +Z direction and then extends in the −X direction until position (d). At position (d), the first loop antenna 20 extends in the −Z direction and then extends in the −Y direction until position (e). Additionally, the first loop antenna 20 extends from position (f) in the +Z direction until the second end 34.

In this embodiment, the second antenna 22 extends from position (g) in the +X direction, then makes a right angled turn, extends in the −Y direction, then makes a further right angled turn and extends in the −X direction until the open end 40 of the second antenna 22. The third antenna 24 extends from position (h) in the −X direction until the open end 44 of the third antenna 24. Consequently, the second antenna 22 and the third antenna 24 are positioned within the cavity 35 defined by the first loop antenna 20.

As illustrated in FIG. 3A, the first end 32 is connected to a feed point 50 on the ground member 18, and the second end 34 is connected to a ground point 52 on the ground member 18. In this embodiment, the apparatus 12 does not overlay the ground member 18 when viewed in plan (that is, the X-Z plane). However in other embodiments, the apparatus 12 may fully overlay or partially overlay the ground member 18 when viewed in plan. Additionally, in other embodiments the feed point 50 may not be provided on the ground member 18 and may instead be provided on a non-conductive substrate for example.

The mid-point 36 of the first loop antenna 20 and at least a portion of the second antenna 22 is positioned in an overlaying arrangement with a first conductive portion of the first loop antenna 20 (the portion of the first loop antenna 20 between the first end 32 and position (a)) and a second conductive portion of the first loop antenna 20 (the portion of the first loop antenna 20 between the second end 34 and position (f)).

Figure 4:
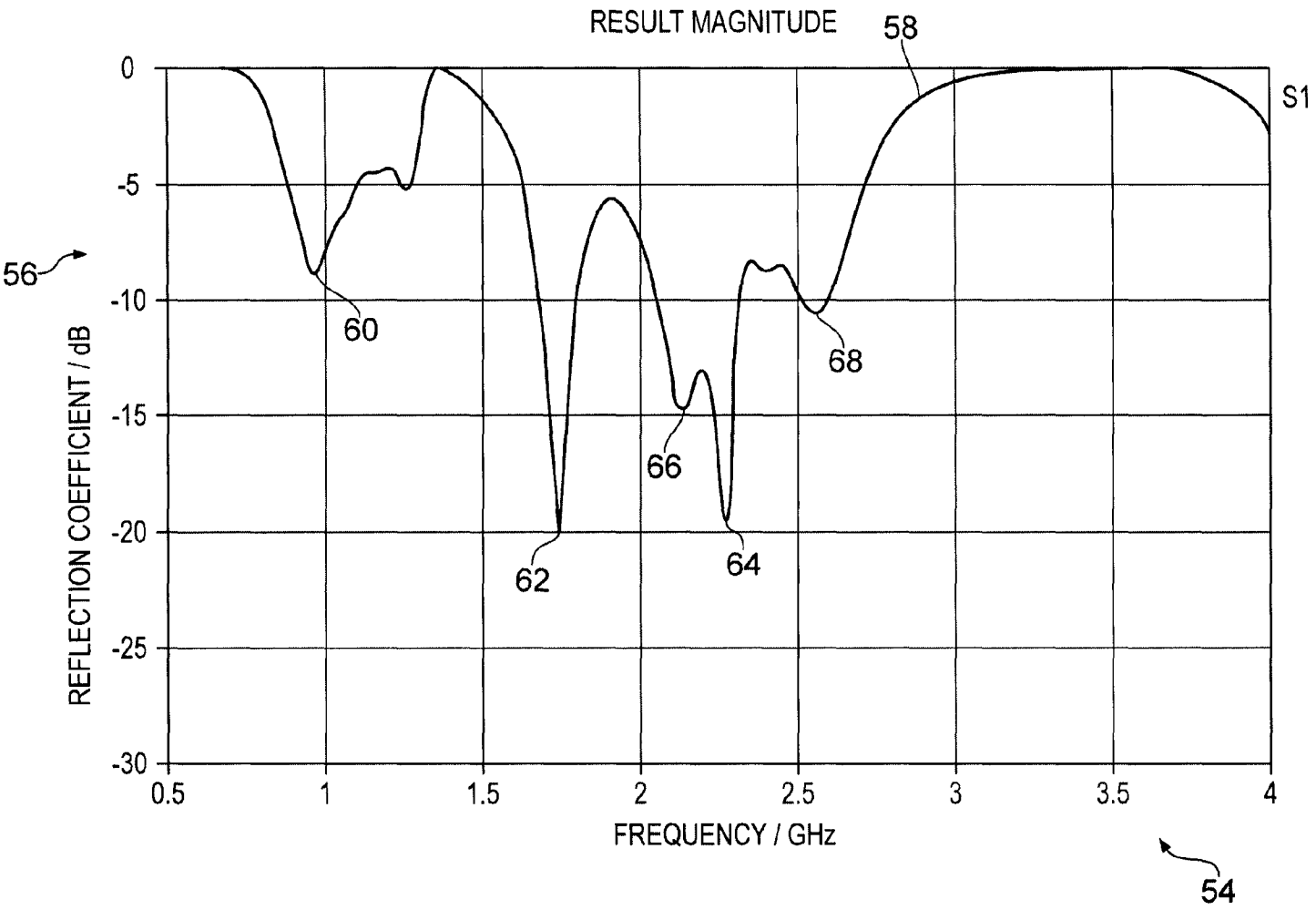
FIG. 4 illustrates a graph of reflection coefficient versus frequency for the apparatus illustrated in FIGS. 3A and 3B.

FIG. 4 illustrates a graph of reflection coefficient versus frequency for the apparatus 12 illustrated in FIGS. 3A and 3B. The graph includes a horizontal axis 54 that represents frequency in GHz and a vertical axis 56 that represents reflection coefficient in dB. The graph also includes a trace 58 that represents the variation in the reflection coefficient of the apparatus 12 with frequency.

The trace 58 has a first minima 60 at approximately 0.95 GHz and −8 dB, a second minima 62 at approximately 1.75 GHz and −20 dB, a third minima 64 at approximately 2.3 GHz and −19.5 dB, a fourth minima 66 at approximately 2.15 GHz and −15 dB and a fifth minima 68 at approximately 2.6 GHz and −10.6 dB.

The first minima 60 corresponds to an unbalanced two 1/4λ (folded monopole) mode of the first loop antenna 20 and provides the first operational resonant frequency band. The second minima 62 corresponds to an unbalanced two 3/4λ asymmetric mode of the first loop antenna 20 and the second antenna 22 and provides the second operational resonant frequency band. The third minima 64 corresponds to an unbalanced two 3/4λ asymmetric mode of the first loop antenna 20 and the third antenna 24 and provides the third operational resonant frequency band. The fourth minima 66 corresponds to a balanced two 1/2λ (folded dipole) mode of the first loop antenna 20 and provides a fourth operational resonant frequency band. The fifth minima 68 corresponds to a balanced two λ (folded dipole) asymmetric mode of the first loop antenna 20 and provides a fifth operational resonant frequency band. As illustrated in FIG. 4, the second, third, fourth and fifth operational resonant frequency bands provide a reflection coefficient of at least −6 dB between 1.6 GHz and 2.7 GHz. It should be appreciated that the word 'mode' may also be referred to as a 'resonance', that an unbalanced mode may also be referred to as a common mode and that a balanced mode may also be referred to as a differential mode.

It should also be appreciated that the first electrical length 38 of the first loop antenna 20, the second electrical length 42 of the second antenna 22 and the third electrical length 46 of the third antenna 24 are selected or configured so that the first loop antenna 20, the second antenna 22 and the third antenna 24 resonate in the operational resonant frequency bands mentioned in the previous paragraphs. It should also be appreciated that the first, second and third electrical lengths 38, 42, 46 may be different in other embodiments and the apparatus 12 may consequently resonate in different operational resonant frequency bands to those illustrated in FIG. 4.

Figure 5:
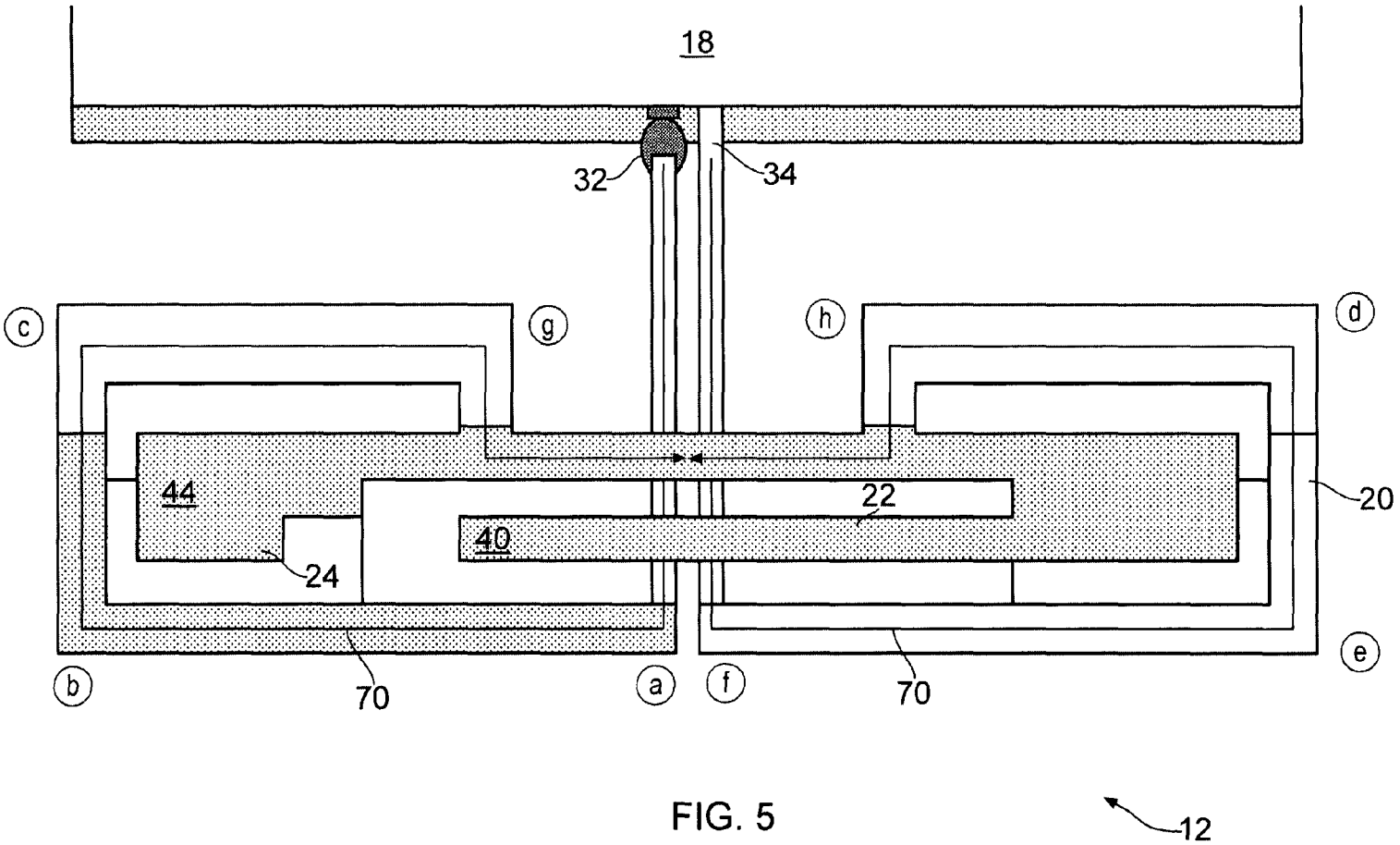
FIG. 5 illustrates a first resonant mode of the apparatus illustrated in FIGS. 3A and 3B.

FIG. 5 illustrates the electric current flow of a first resonant mode 70 of the apparatus 12 illustrated in FIGS. 3A and 3B. The apparatus 12 is illustrated as planar in FIG. 5 to aid in the illustration of the first resonant mode.

The first resonant mode 70 of the apparatus 12 is an unbalanced two 1/4λ (folded monopole) mode of the first loop antenna 20 and provides the first minima 60 illustrated in FIG. 4. The first resonant mode 70 extends between the first end 32 and the second end 34 and passes through positions (a), (b), (c), (g), (h), (d), (e) and (f) in the first loop antenna 20.

Figure 6A:
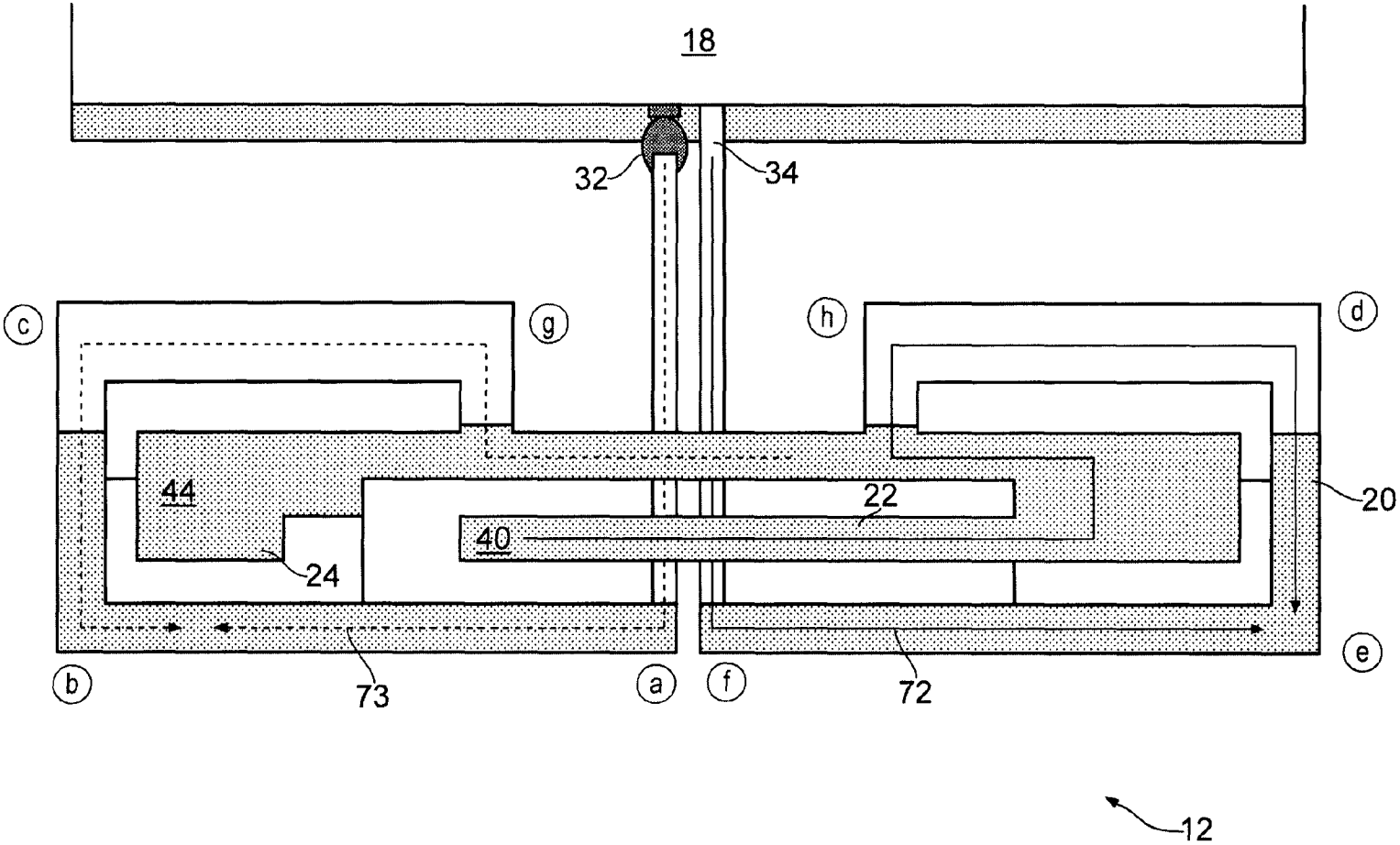
FIG. 6A illustrates a second resonant mode of the apparatus illustrated in FIGS. 3A and 3B.

FIG. 6A illustrates the electric current flow of a second resonant mode 72 of the apparatus 12 illustrated in FIGS. 3A and 3B. The apparatus 12 is illustrated as planar in FIG. 6 to aid in the illustration of the second resonant mode.

The second resonant mode 72, 73 of the apparatus 12 is an unbalanced two 3/4λ mode of the first loop antenna 20 and the second antenna 22 and provides the second minima 62 illustrated in FIG. 4. The electric current flow 72 extends between the second end 34 of the first loop antenna 20 and the open end 40 of the second antenna 22 and passes through positions (f), (e), (d) and (h). The electric current flow 73 extends between the first end 32 of the first loop antenna 20 and position (g) and passes through positions (a), (b) and (c).

The current distribution in the electric current flow 72 is greater than the current distribution in the electric current flow 73 and the electric current flow 72 may therefore be considered as a dominant mode and as a 3/4λ monopole mode.

Figure 6B:
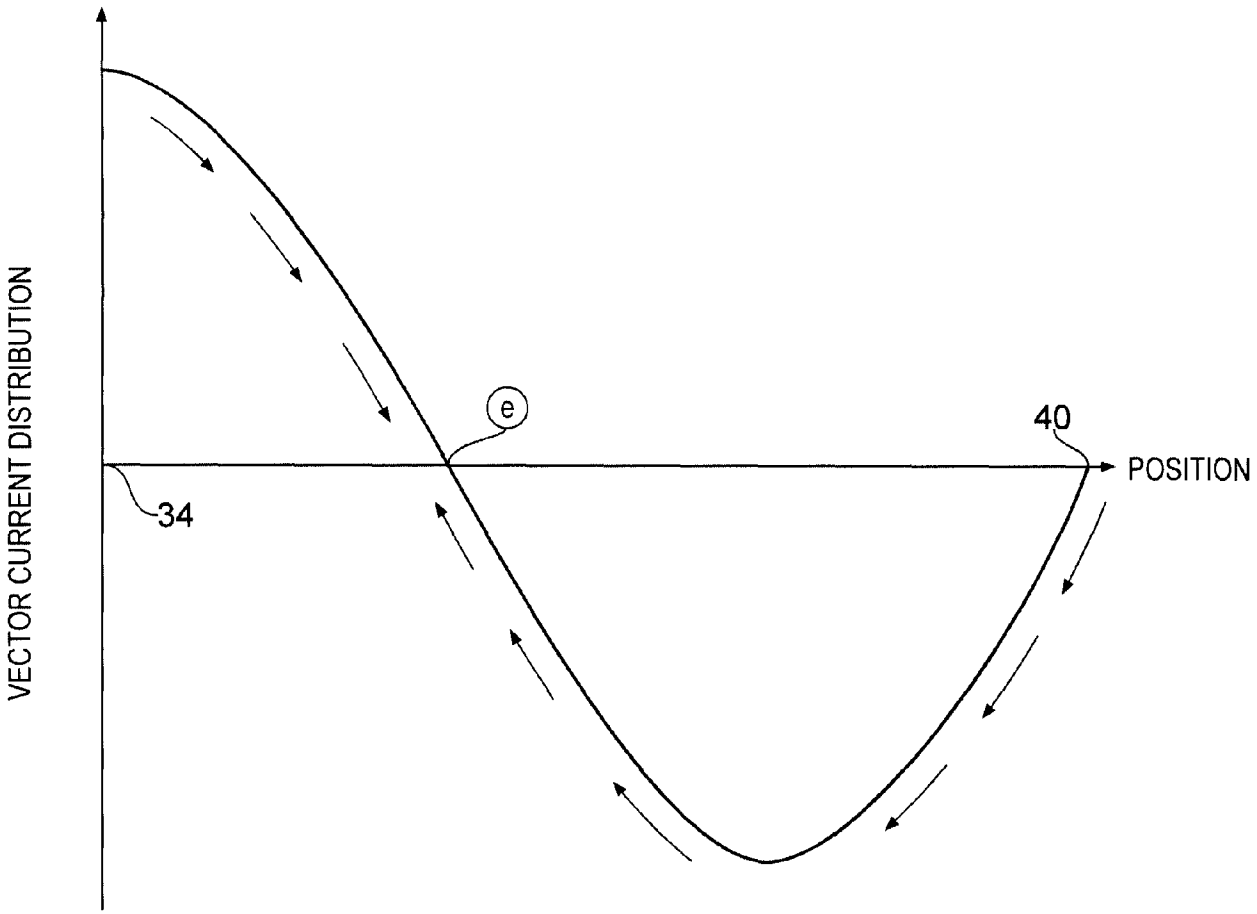
FIG. 6B illustrates a graph of current distribution versus position for the second resonant mode illustrated in FIG. 6A.

FIG. 6B illustrates a graph of current distribution versus position along the first loop antenna 20 and the second antenna 22 for the electric current flow 72 of the second resonant mode illustrated in FIG. 6A. The horizontal axis commences at the second end 34 on the left hand side of the graph and finishes at the open end 40 on the right hand side of the graph and is equal to 3/4λ at the second resonant mode. At the second end 34, the current density is at a maximum and is flowing away from the second end 34 and towards the position (e). At position (e) and at the open end 40, the current density is approximately zero. At a position substantially halfway between position (e) and the open end 40, the magnitude of the current density is at a maximum. The current between positions (e) and the open end 40 flows towards position (e).

Figure 7:
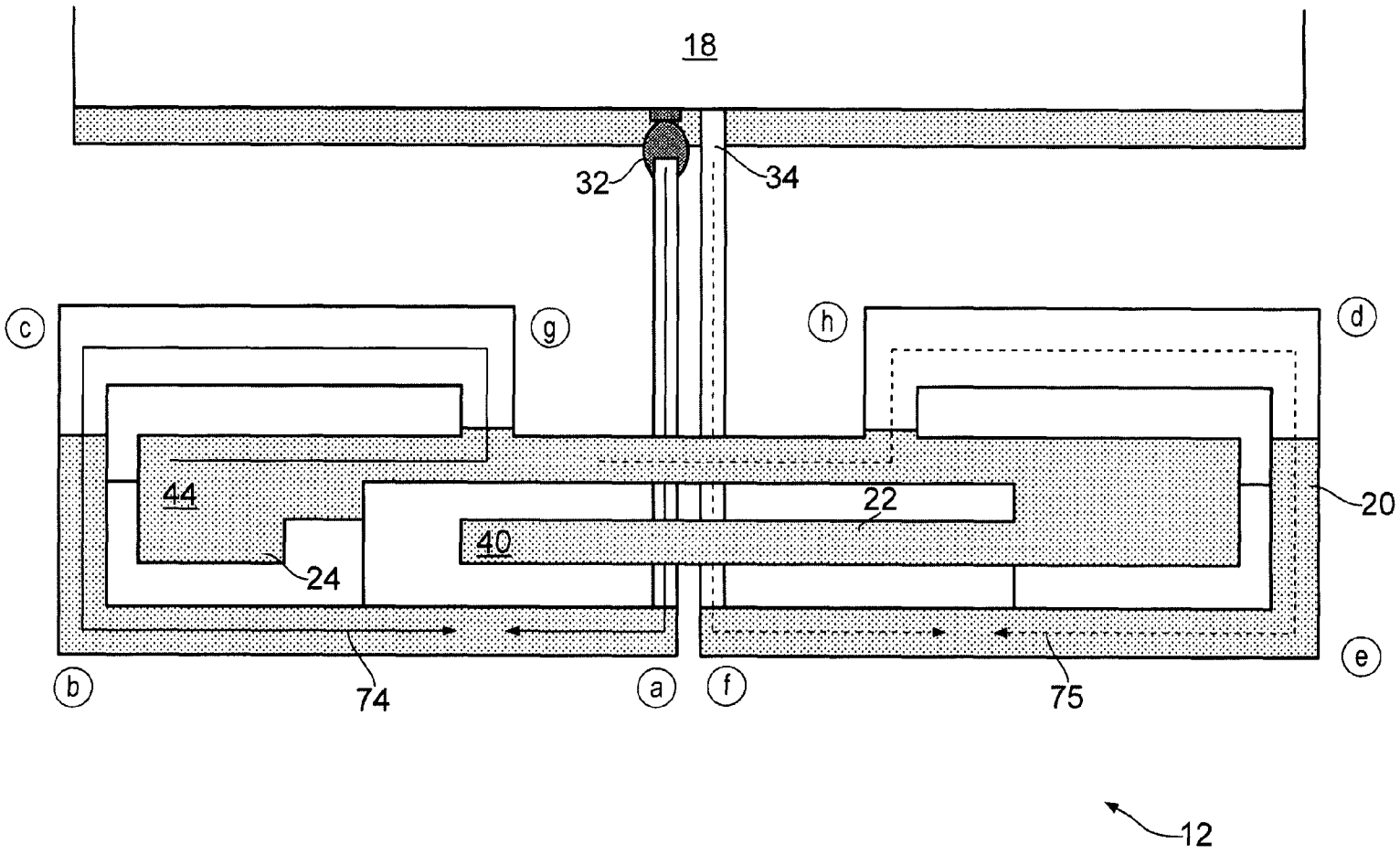
FIG. 7 illustrates a third resonant mode of the apparatus illustrated in FIGS. 3A and 3B.

FIG. 7 illustrates the electric current flow of a third resonant mode 74, 75 of the apparatus 12 illustrated in FIGS. 3A and 3B. The apparatus 12 is illustrated as planar in FIG. 7 to aid in the illustration of the third resonant mode.

The third resonant mode 74, 75 of the apparatus 12 is an unbalanced two 3/4λ asymmetric mode of the third antenna 24 and provides the third minima 64 illustrated in FIG. 4. The electric current flow 74 extends between the first end 32 of the first loop antenna 20 and the open end 44 of the third antenna 24 and passes through positions (a), (b), (c) and (g). The electric current flow 75 extends between the second end 34 of the first loop antenna 20 and position (h) and passes through positions (f), (e), (d) and (h).

The current distribution in the electric current flow 74 is greater than the current distribution in the electric current flow 75 and the electric current flow 74 may therefore be considered as a dominant mode and as a 3/4λ monopole mode.

Figure 8:
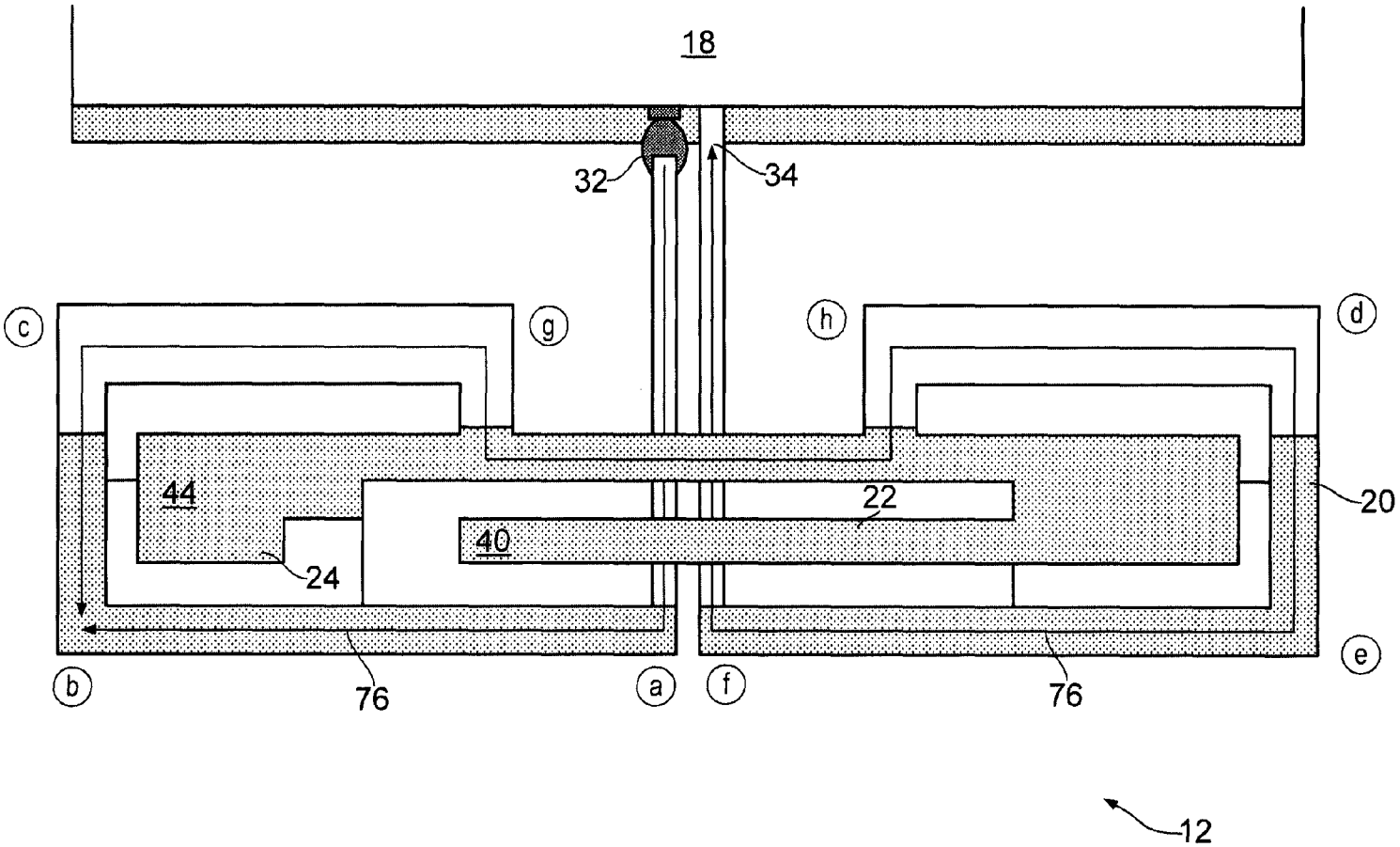
FIG. 8 illustrates a fourth resonant mode of the apparatus illustrated in FIGS. 3A and 3B.

FIG. 8 illustrates the electric current flow of a fourth resonant mode 76 of the apparatus 12 illustrated in FIGS. 3A and 3B. The apparatus 12 is illustrated as planar in FIG. 8 to aid in the illustration of the fourth resonant mode.

The fourth resonant mode 76 of the apparatus 12 is a balanced two 1/2λ (folded dipole) mode of the first loop antenna 20 and provides the fourth minima 66 illustrated in FIG. 4. The fourth resonant mode 76 extends between the first end 32 and the second end 34 and passes through positions (a), (b), (c), (g), (h), (d), (e) and (f) in the first loop antenna 20.

Figure 9:
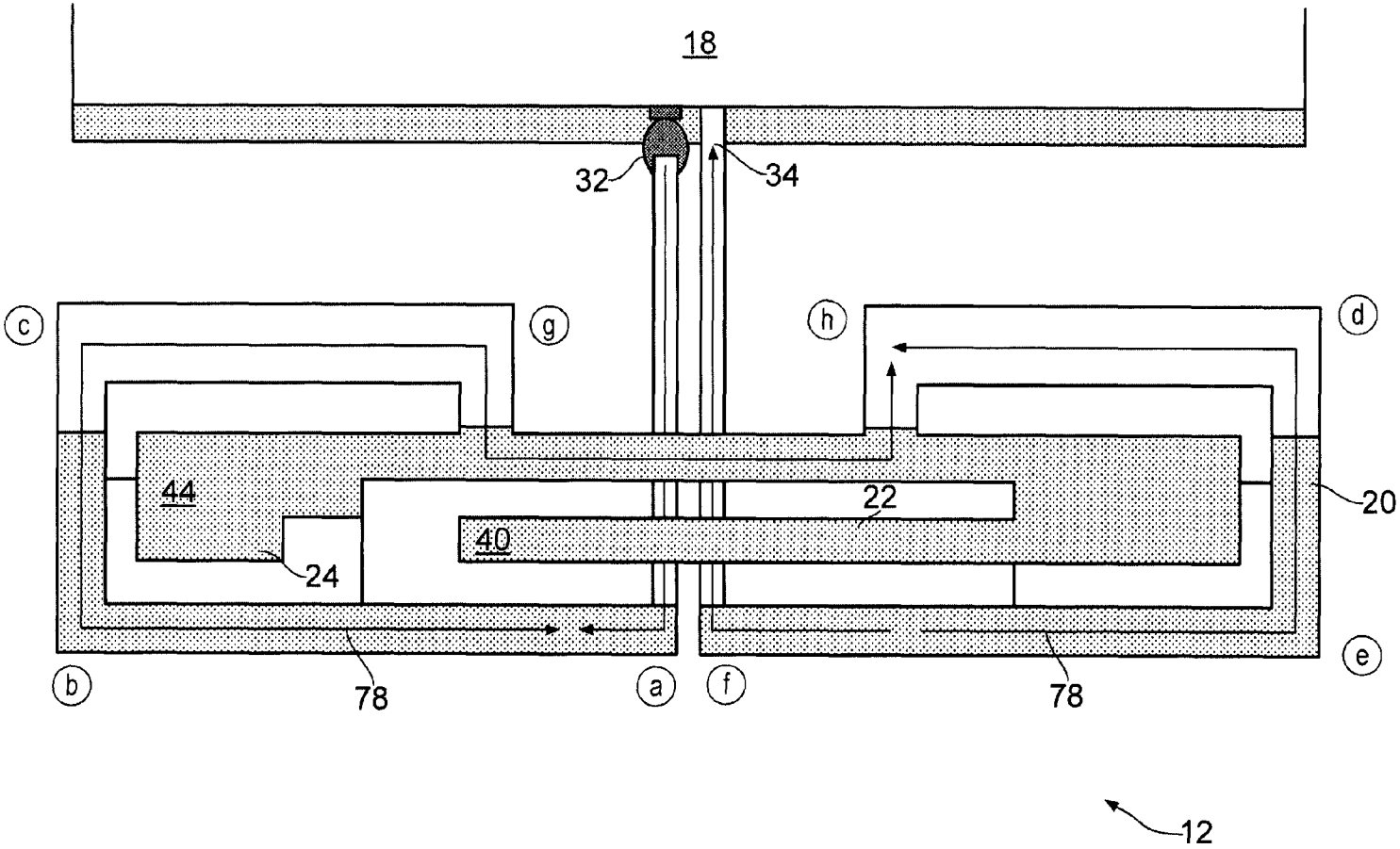
FIG. 9 illustrates a fifth resonant mode of the apparatus illustrated in FIGS. 3A and 3B.

FIG. 9 illustrates the electric current flow of a fifth resonant mode 78 of the apparatus 12 illustrated in FIGS. 3A and 3B. The apparatus 12 is illustrated as planar in FIG. 9 to aid in the illustration of the fifth resonant mode.

The fifth resonant mode 78 of the apparatus 12 is a balanced two A (folded dipole) asymmetric mode of the first loop antenna 20 and provides the fifth minima 68 illustrated in FIG. 4. The fifth resonant mode 78 extends between the first end 32 and the second end 34 and passes through positions (a), (b), (c), (g), (h), (d), (e) and (f) in the first loop antenna 20.

The apparatus 12 illustrated in FIGS. 3A and 3B is therefore advantageously configured to operate in five different operational resonant frequency bands and is also relatively small since the second antenna 22 and the third antenna 24 are positioned within the cavity 35 of the first loop antenna 20. In one exemplary embodiment, the apparatus 12 has a length of 50 mm, a width of 13 mm and a height of 5.2 mm and the ground member 18 has a length of 108 mm and a width of 50 mm.

Figure 10:
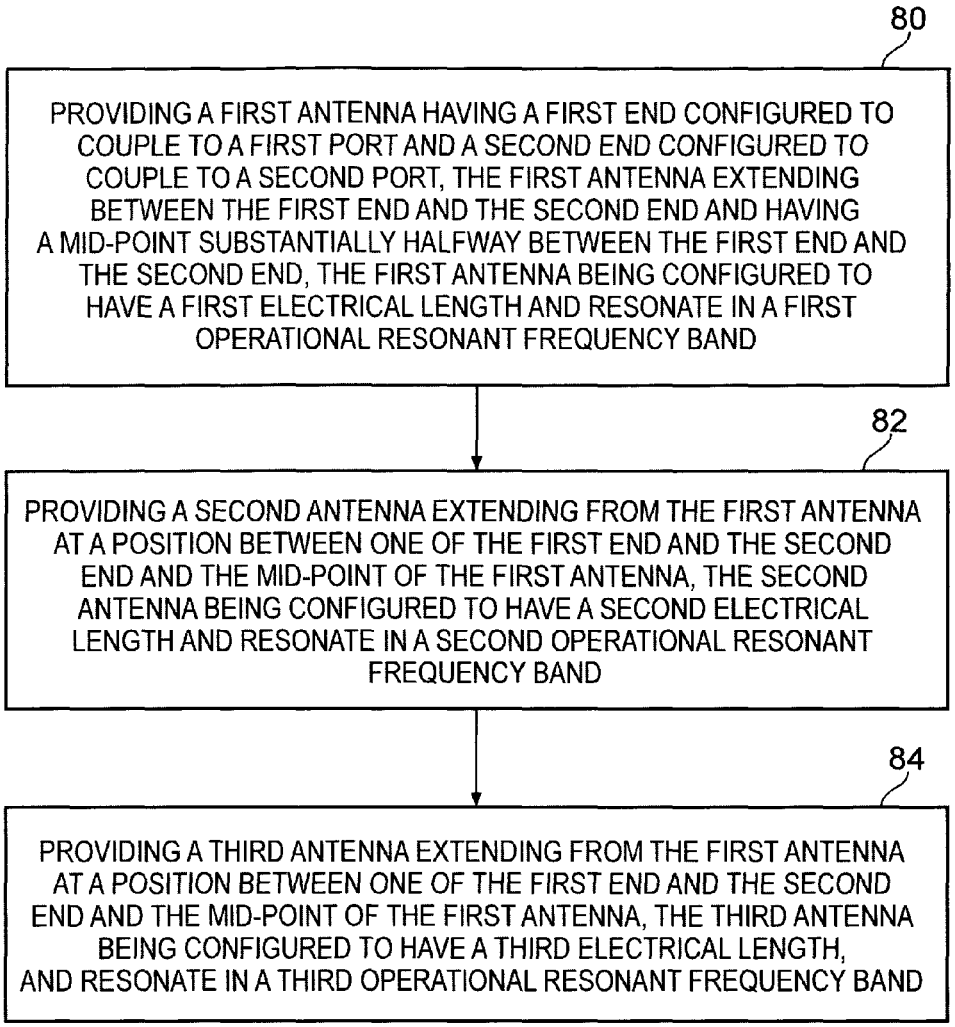
FIG. 10 illustrates a flow diagram of a method of manufacturing an apparatus according to various embodiments of the invention.

FIG. 10 illustrates a flow diagram of a method of manufacturing an apparatus 12 according to various embodiments of the invention.

At block 80, the method includes providing a first antenna 20 having a first end 32 configured to couple to a first port and a second end 34 configured to couple to a second port, the first loop antenna 20 extending between the first end 32 and the second end 34 and having a mid-point 36 substantially halfway between the first end 32 and the second end 34. The first loop antenna 20 is configured to have a first electrical length 38 and resonate in a first operational resonant frequency band.

At block 82, the method includes providing a second antenna 22 extending from the first antenna 20 at a position between one of the first end 32 and the second end 34 and the mid-point 36 of the first loop antenna 20. The second antenna 22 is configured to have a second electrical length 42 and resonate in a second operational resonant frequency band.

At block 84, the method includes providing a third antenna 24 extending from the first antenna 20 at a position between one of the first end 32 and the second end 34 and the mid-point 36 of the first loop antenna 20. The third antenna 24 is configured to have a third electrical length 46, different to the second electrical length 42, and resonate in a third operational resonant frequency band.

It should be appreciated that where the first antenna 20, the second antenna 22 and the third antenna 24 are formed integrally, the blocks 80, 82, 84 may be performed simultaneously where the shape of the apparatus 12 is punched out of a single piece of material.

The blocks illustrated in the FIG. 10 may represent steps in a method and/or sections of code in the computer program. For example, a processor or a controller may execute the computer program to control machinery to perform the method blocks illustrated in FIG. 10. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, the bends in the antennas 20, 22, 24 of the apparatus 12 may define an angle that is more or less than ninety degrees and may be curved.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a first antenna having a first end configured to couple to a first port and a second end configured to couple to a second port, the first antenna extending between the first end and the second end and having a mid-point substantially halfway between the first end and the second end, the first antenna being configured to have a first electrical length and resonate in a first operational resonant frequency band;

a second antenna extending from the first antenna at a position between one of the first end and the second end and the mid-point of the first antenna, the second antenna being configured to have a second electrical length and resonate in a second operational resonant frequency band; and a third antenna extending from the first antenna at a position between one of the first end and the second end and the mid-point of the first antenna, the third antenna being configured to have a third electrical length and resonate in a third operational resonant frequency band, and wherein the midpoint is positioned to overlie a first conductive portion of the first antenna and a second conductive portion of the first antenna, the first and second conductive portions defining a space therebetween and being configured to couple to the first and second ports respectively, wherein a portion of the first antenna that includes the mid-point lies in a different plane than other portions of the first antenna that extend at least partially between a respective one of the first and second conductive portions and the portion of the first antenna that includes the mid-point, and wherein the position from which the second antenna extends from the first antenna is offset from the mid-point of the first antenna.

2. An apparatus as claimed in claim 1, wherein the second antenna is a monopole antenna and is configured to resonate in a $3\lambda/4$ mode to operate in the second operational resonant frequency band.

3. An apparatus as claimed in claim 2, wherein the second electrical length extends from one of the first end and the second end of the first antenna to an open end of the second antenna.

4. An apparatus as claimed in claim 1, wherein the third antenna is a monopole antenna and is configured to resonate in a $3\lambda/4$ mode to operate in the third operational resonant frequency band.

5. An apparatus as claimed in claim 4, wherein the third electrical length extends from one of the first end and the second end of the first antenna to an open end of the third antenna.

6. An apparatus as claimed in claim 1, wherein the first antenna defines a cavity and the second and third antennas are positioned within the cavity.

7. An apparatus as claimed in claim 1, wherein the first antenna defines a cavity and at least one of the second and third antennas are positioned external to the cavity.

8. An apparatus as claimed in claim 1, wherein the first antenna is configured to operate in a fourth operational resonant frequency band and in a fifth operational resonant frequency band, the second, third, fourth and fifth operational resonant frequency bands being configured to provide a reflection coefficient of at least −6 dB between 1.6 GHz and 2.7 GHz.

9. An apparatus as claimed in claim 1, wherein the second port is a ground point.

10. An apparatus as claimed in claim 1, wherein the first port is a feed point.

11. An apparatus as claimed in claim 1, wherein the second electrical length is different to the third electrical length and the second operational resonant frequency band is different to the third operational resonant frequency band.

12. An apparatus as claimed in claim 1, wherein the second electrical length is substantially the same as the third electrical length and the second operational resonant frequency band substantially overlaps the third operational resonant frequency band.

13. An apparatus as claimed in claim 1, wherein the second antenna is configured to have a first physical length and the third antenna is configured to have a second physical length, the first physical length being different to the second physical length.

14. A module comprising an apparatus as claimed in claim 1.

15. An electronic communication device comprising an apparatus as claimed in claim 1.

16. A method comprising:

providing a first antenna having a first end configured to couple to a first port and a second end configured to couple to a second port, the first antenna extending between the first end and the second end and having a mid-point substantially halfway between the first end and the second end, the first antenna being configured to have a first electrical length and resonate in a first operational resonant frequency band;

providing a second antenna extending from the first antenna at a position between one of the first end and the second end and the mid-point of the first antenna, the second antenna being configured to have a second electrical length and resonate in a second operational resonant frequency band; and providing a third antenna extending from the first antenna at a position between one of the first end and the second end and the mid-point of the first antenna, the third antenna being configured to have a third electrical length and resonate in a third operational resonant frequency band, and wherein the midpoint is positioned to overlie a first conductive portion of the first antenna and a second conductive portion of the first antenna, the first and second conductive portions defining a space therebetween and being configured to couple to the first and second ports respectively, wherein a portion of the first antenna that includes the mid-point lies in a different plane than other portions of the first antenna that extend at least partially between a respective one of the first and second conductive portions and the portion of the first antenna that includes the mid-point, and wherein the position from which the second antenna extends from the first antenna is offset from the mid-point of the first antenna.

17. A method as claimed in claim 16, wherein the second antenna is a monopole antenna and is configured to resonate in a $3\lambda/4$ mode to operate in the second operational resonant frequency band.

18. A method as claimed in claim 16, wherein the second electrical length extends from one of the first end and the second end of the first antenna to an open end of the second antenna.

19. A method as claimed in claim 16, wherein the third antenna is a monopole antenna and is configured to resonate in a $3\lambda/4$ mode to operate in the third operational resonant frequency band.

20. A method as claimed in claim 19, wherein the third electrical length extends from one of the first end and the second end of the first antenna to an open end of the third antenna.

* * * * *